United States Patent [19]

Thorpe

[11] 4,056,905

[45] Nov. 8, 1977

[54] PRE-STRESSED CONCRETE STRUCTURES

[75] Inventor: Walter Thorpe, Stockport, England

[73] Assignee: Simonbuild Limited, Stockport, England

[21] Appl. No.: 668,426

[22] Filed: Mar. 19, 1976

[51] Int. Cl.[2] ..... E04C 3/10; E02B 1/00

[52] U.S. Cl. ..... 52/223 R; 61/87; 61/100; 264/32; 264/34; 264/228

[58] Field of Search ..... 264/228, 32, 34; 61/46.5, 100, 87; 52/230, 301, 223

[56] References Cited

U.S. PATENT DOCUMENTS

| | | | |
|---|---|---|---|
| 1,489,742 | 4/1924 | Davenhall | 52/301 X |
| 3,216,162 | 11/1965 | Gerber et al. | 52/230 |
| 3,249,664 | 5/1966 | Georgii | 61/46 |
| 3,307,310 | 3/1967 | Kourkene | 52/230 |
| 3,537,268 | 11/1970 | Georgii | 61/46 |

FOREIGN PATENT DOCUMENTS

| | | | |
|---|---|---|---|
| 278,246 | 7/1965 | Australia | 52/230 |
| 1,366,770 | 9/1974 | United Kingdom | 61/46.5 |

OTHER PUBLICATIONS

Engineering News-Record May 10, 1973, p. 39.

*Primary Examiner*—Alfred C. Perham
*Attorney, Agent, or Firm*—Norris & Bateman

[57] ABSTRACT

A method of installing a tendon in a duct in a slip-formed concrete structure including the steps of providing a tubular member which forms the uppermost part of the duct and whose upper end terminates at the level where the upper end of the tendon is to be anchored, said tubular member having outwardly extending abutment means at or adjacent its lower end, said abutment means being of such size and at such depth below the upper end of the tubular member as to enable the forces necessary to instal and support a tendon in the duct, at the time when the concrete structure reaches a height in the vicinity of the upper end of said tubular member, to be transmitted through the tubular member and distributed to the concrete structure by the abutment means at a level where the concrete has gained adequate strength for this purpose.

8 Claims, 3 Drawing Figures

PRE-STRESSED CONCRETE STRUCTURES

This invention concerns the installation of a pre-stressing tendon in a duct in a vertically extending concrete structure of the kind produced by continuously placing concrete into shuttering which is progressed upwardly. Such a concrete structure will be referred to hereinafter as a slip-formed structure.

With concrete structures of considerable height it is often necessary for the ends of prestressing tendons to be anchored at position in the structure intermediate the upper and lower ends of the structure.

With slip-formed structures it has been usual either to support the tendons in position and form the structure around them, or to provide ducts extending through wall surfaces of the structure to permit the installation of the tendons subsequently. Both of these methods have disadvantages particularly with structures of very considerable height.

The installation of a tendon in a duct in a slip-formed structure at the time that the structure reaches a height where the upper end of the tendon is to be anchored presents special problems in that the upper region of the concrete structure itself may be insufficiently cured to support the weight of the tendon or carry the forces necessary to fit the tendon into the duct, it not always being convenient to provide an independent structure capable of carrying these forces.

It is an object of the present invention to provide a method enabling the installation of a tendon in a duct in a slip-formed concrete structure which overcomes the problems aforesaid.

According to the present invention, a method of installing a tendon in a duct in a slip-formed concrete structure includes the steps of providing a tubular member which forms the uppermost part of the duct and whose upper end terminates at the level where the upper end of the tendon is to be anchored, said tubular member having outwardly extending abutment means at or adjacent its lower end, said abutment means being of such size and at such depth below the upper end of the tubular member as to enable the forces necessary to instal and support a tendon in the duct, at the time when the concrete structure reaches a height in the vicinity of the upper end of said tubular member, to be transmitted through the tubular member and distributed to the concrete structure by the abutment means at a level where the concrete has gained adequate strength for this purpose.

The invention will be further apparent from the following description with reference to the figures of the accompanying drawing which show by way of example only, a typical concrete structure fitted with tendons in accordance with the method of the invention.

Figure 3:
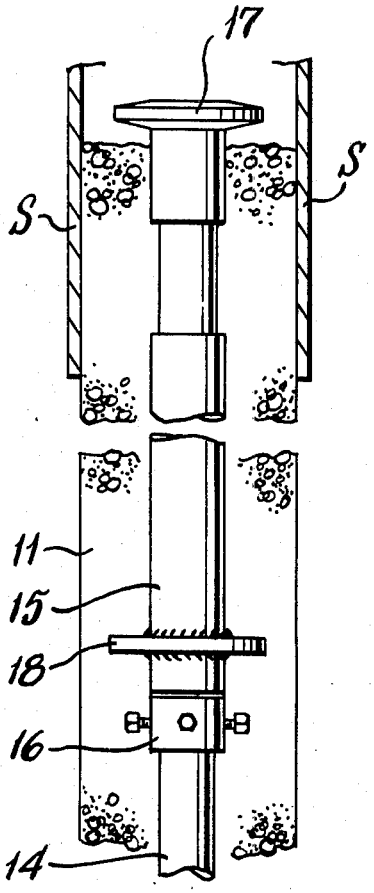
Figure 2:
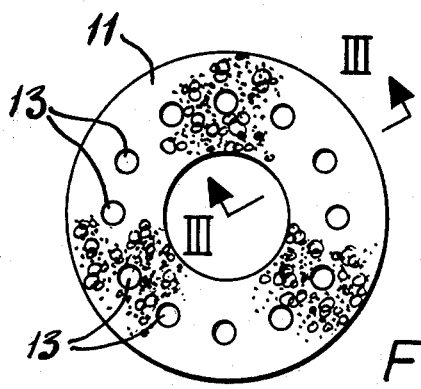
FIG. 2 shows a cross-section through one of the legs of the platform on the line II—II of FIG. 1.

and FIG. 3 shows a cross-section through the wall of the leg on the line III—III of FIG. 2 at the time that it was being formed.

Figure 1:
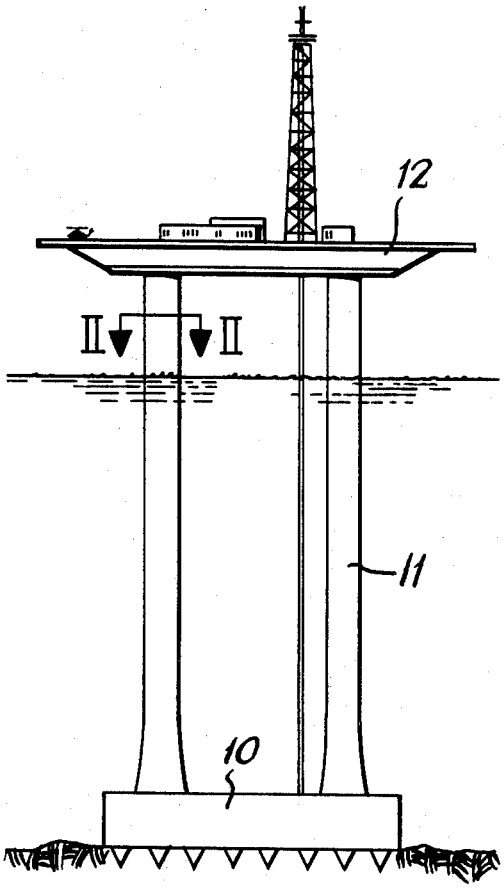
FIG. 1 shows a side elevation of the concrete structure being a platform for off-shore oil production.

Referring firstly to FIG. 1, it will be seen that the production platform essentially comprises a base portion 10 which is located on the sea bed. Extending upwardly from the portion 10 are a number of legs 11 which terminate at a position above sea level there to support a deck structure 12 which mounts the necessary equipment and living accommodation.

Each leg 11 is produced by the so-called slip-forming method where the concrete is placed continuosuly into shuttering S (see FIG. 3) which is progressed upwardly without interruption over the entire height of the leg as it formed.

As best seen from FIG. 2, there are a plurality of circumferentially spaced vertically extending ducts 13 disposed within each leg 11. These ducts 13 carry pre-stressing tendons. All of the tendons extend from the base of the leg 11 but different ones terminate at different levels in the height of the leg 11.

Each duct 13 is defined by sections of tube 14 around which the concrete is poured. During formation of the leg 11, as the concrete structure approaches the level where the upper end of a tendon is to be anchored the duct 13 which is to receive the tendon is completed by a special tubular member 15 which is secured to the tube section 14 therebelow by a suitable clamp means 16.

The member 15 is provided with a bearing plate 17 for a pre-stressing tendon at its upper end and also abutment means, in this example comprised by a flange 18, extending outwardly from its periphery at or adjacent its lower end. The size of the abutment means and the depth thereof below the plate 17 are so selected, having regard to the charcteristics of the concrete from which the leg 11 is formed and the speed at which it is formed, that when the concrete reaches the level of the plate 17 the abutment means will be located in concrete which has hardened sufficiently to enable the weight of the tendon and any forces necessary for its installation to be transmitted thereto through the member 15 and flange 18 from the bearing plate 17 with complete safety.

In this manner the tendons can be installed in each leg 11 by drawing them upwardly from the base portion 10 whenever the height of the leg 11 reaches a level where a tendon is to be anchored. Alternatively the tendons may be lowered into the ducts when they reach the required heights.

The tendons are not, of course, tensioned until the concrete structure is adequately cured. The tensioning operation is effected in known manner by means of hydraulic jacks at the base of the legs 11.

It will be appreciated that it is not intended to limit the invention to the above example only, many variations, such as might readily occur to one skilled in the art, being possible without departing from the scope thereof, as defined by the appended claims.

What is claimed is:

1. A method of installing a tendon in a longitudinally extending duct in an elongated generally vertical concrete structure while said structure is being slip-formed comprising the steps of providing a tubular member to form the uppermost part of said duct, said member having a laterally outwardly extending abutment at or near its lower end and being of such length that its upper end terminates at the level where the upper end of a tendon is to be anchored with said abutment so spaced below said upper end of the tubular member that, a the time the upwardly growing concrete structure reaches a height in the vicinity of said upper end, said abutment is located within the structure at an operative level where the concrete has sufficiently hardened and developed sufficient strength to enable forces necessary to install and support a tendon in the duct to be transmitted through the tubular member and abutment to be distributed in the developed concrete structure at that operative level.

2. A method according to claim 1 wherein the tendon is drawn up into the duct from the bottom thereof to have its upper end secured at the upper end of said tubular member when the concrete structure reaches a height in the vicinity of the upper end of said tubular member.

3. A method according to claim 1 wherein a tendon is lowered into said duct to have its upper end secured at the upper end of said tubular member when the concrete structure reaches a height in the vicinity of the upper end of said tubular member.

4. A method according to claim 2 wherein said tendon is tensioned from the base of the duct after the concrete of the structure lying between the base of the structure and the upper end of the endon is cured.

5. A method according to claim 3 wherein said tendon is tensioned from the base of the duct after the concrete of the structure lying between the base of the structure and the upper end of the tendon is cured.

6. Equipment for installing a tendon in a longitudinally extending duct in an elongated generally vertical concrete structure while said structure is being slip-formed comprising a tubular member adapted to be inserted to form the uppermost part of said duct, said member having outwardly extending abutment means at or near its lower end and being of such length that its upper end terminates at the level where the upper end of a tendon is to be anchored with said abutment means so spaced below said upper end of the tubular member that, at the time the upwardly growing concrete structure reaches a height in the vicinity of said upper end, said abutment means is located within the structure at an operative level where the concrete has sufficiently hardened and developed sufficient strength to enable forces necessary to install and support a tendon in the duct to be transmitted through the tubular member and abutment means to be distributed in the developed concrete structure at that operative level, said member having a bearing plate for a prestressing tendon at its said upper end.

7. Equipment according to claim 6 wherein said autment means is comprised by at least one outwardly extending flange.

8. An off-shore drilling or production platform having legs extending upwardly from the sea bed, said legs being slip-formed structures containing the equipment defined in claim 6.

* * * * *

UNITED STATES PATENT OFFICE

CERTIFICATE OF CORRECTION

Patent No. 4,056,905 Dated November 8, 1977

Inventor(s) Walter Thorpe

It is certified that error appears in the above-identified patent and that said Letters Patent are hereby corrected as shown below:

Claim No. 1, Column 2, line 62, change "a" to --at--.

Claim No. 4, Column 3, line 17, change "endon" to --tendon--.

Claim No. 7, Column 4, line 18, change "autment" to --abutment-

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*